US007597635B2

(12) United States Patent
Davies

(10) Patent No.: US 7,597,635 B2
(45) Date of Patent: Oct. 6, 2009

(54) OVERSIZED BASKETBALL RIM DEVICE

(76) Inventor: David Davies, P.O. Box 15666, Wilmington, NC (US) 28408

( * ) Notice: Subject to any disclaimer, the term of this patent is extended or adjusted under 35 U.S.C. 154(b) by 45 days.

(21) Appl. No.: 11/703,356

(22) Filed: Feb. 7, 2007

(65) Prior Publication Data

US 2007/0191142 A1 Aug. 16, 2007

Related U.S. Application Data

(60) Provisional application No. 60/765,786, filed on Feb. 7, 2006.

(51) Int. Cl.
*A63B 69/00* (2006.01)

(52) U.S. Cl. ..... 473/447; 473/433; 473/479; D21/703

(58) Field of Classification Search ..... 473/422, 473/433, 448, 447, 479, 485, 486, 487, 488; 273/317.3
See application file for complete search history.

(56) References Cited

U.S. PATENT DOCUMENTS

D114,375 S * 4/1939 Fieldhouse ..... D21/703
3,160,414 A * 12/1964 Gray ..... 473/448
3,342,486 A * 9/1967 Farley ..... 473/448
3,814,421 A * 6/1974 Spier, Jr. ..... 473/433
4,613,135 A 9/1986 Rush
4,836,539 A * 6/1989 Knapp ..... 473/433
4,877,241 A * 10/1989 Rothbard ..... 473/485
5,022,649 A 6/1991 Traub et al.
5,156,394 A * 10/1992 Deal ..... 473/485
5,165,680 A * 11/1992 Cass ..... 473/433
5,171,009 A * 12/1992 Filewich et al. ..... 473/433
D365,375 S * 12/1995 Lee ..... D21/703
D368,942 S * 4/1996 Mahoney ..... D21/781
5,536,003 A * 7/1996 Brenner ..... 473/481
5,665,016 A * 9/1997 Burnett ..... 473/448
5,746,668 A * 5/1998 Ochs ..... 473/433
5,830,088 A * 11/1998 Franklin de Abreu ..... 473/433
6,045,463 A * 4/2000 Cass ..... 473/433
6,913,551 B1 * 7/2005 Foley ..... 473/448
6,932,723 B1 * 8/2005 Klinger et al. ..... 473/448
D532,476 S * 11/2006 Coryatt ..... D21/781
D545,391 S * 6/2007 Coryatt ..... D21/781
2004/0043841 A1 * 3/2004 Williams ..... 473/448

* cited by examiner

*Primary Examiner*—Mitra Aryanpour
(74) *Attorney, Agent, or Firm*—James Ray & Assoc.

(57) ABSTRACT

An oversized basketball rim device for retrofitting onto an existing standard sized basketball rim attached to a backboard of a raised goal which increases an opportunity of making a basket when shooting a basketball.

7 Claims, 2 Drawing Sheets

OVERSIZED BASKETBALL RIM DEVICE

CROSS REFERENCE TO RELATED APPLICATION

This application is closely related to and claims priority from U.S. Provisional Patent Application Ser. No. 60/765,786 filed on Feb. 7, 2006, and its teachings are incorporated into the present document by reference thereto.

FIELD OF THE INVENTION

The present invention relates, in general, to raised basketball hoop assemblies and, more particularly, the invention relates to an oversized basketball rim device for retrofitting onto an existing standard sized basketball rim.

BACKGROUND OF THE INVENTION

Prior to the conception and development of the present invention, as is generally well known in the prior art, numerous people have been playing basketball at various locations such as gyms, playgrounds, driveways, etc. for many years. The raised goal assemblies used at these locations generally consist of a rim attached to a backboard and a means for positioning the rim a predetermined distance above ground level. The rim used is a standard sized rim about 18 inches in diameter.

The number of opportunities for children and special needs players to participate in the popular recreational game of basketball has increased in recent years. However, when novice players attempt to score a basket on a regulation size rim, which is more suited for higher skilled players, they usually have a low rate of success, become frustrated and often lose interest quickly.

SUMMARY OF THE INVENTION

A first aspect of the present invention provides an oversized basketball rim device for retrofitting onto an existing standard sized basketball rim attached to a backboard of a raised goal which increases an opportunity of making a basket when shooting a basketball. The oversized basketball rim device includes an upper rim member having a diameter greater than a diameter of such standard sized basketball rim. There is a funnel shaped band member having an upper portion connected to the upper rim member for directing a basketball from in such upper rim member down through the standard sized basketball rim. A lower rim member having substantially same diameter as diameter of such standard sized basketball rim and connected to a lower portion of the funnel shaped band member seats against such standard sized basketball rim. An attachment means is affixed to the lower rim member for attaching such oversized basketball rim device to the standard sized basketball rim.

A second aspect of the present invention provides an oversized basketball rim device for retrofitting onto an existing standard sized basketball rim attached to a backboard of a raised goal which increases an opportunity of making a basket when shooting a basketball. The oversized basketball rim device includes an upper rim member having a diameter greater than a diameter of such standard sized basketball rim. There are a predetermined plurality of spaced apart rod members having an upper portion connected to the upper rim member for directing a basketball from in the upper rim member down through such standard sized basketball rim. An attachment means is affixed to a lower portion of each of the predetermined plurality of rod members for attaching the oversized basketball rim device to such standard sized basketball rim.

OBJECTS OF THE INVENTION

It is, therefore, one of the primary objects of the present invention to provide an oversized basketball rim device that retrofits onto an existing standard sized basketball rim to increase the chances of novice players making a basket.

Another object of the present invention is to provide an oversized basketball rim device that is easily attached to and removed from an existing standard sized basketball rim.

Yet another object of the present invention is to provide an oversized basketball rim device that is relatively simple to manufacture.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
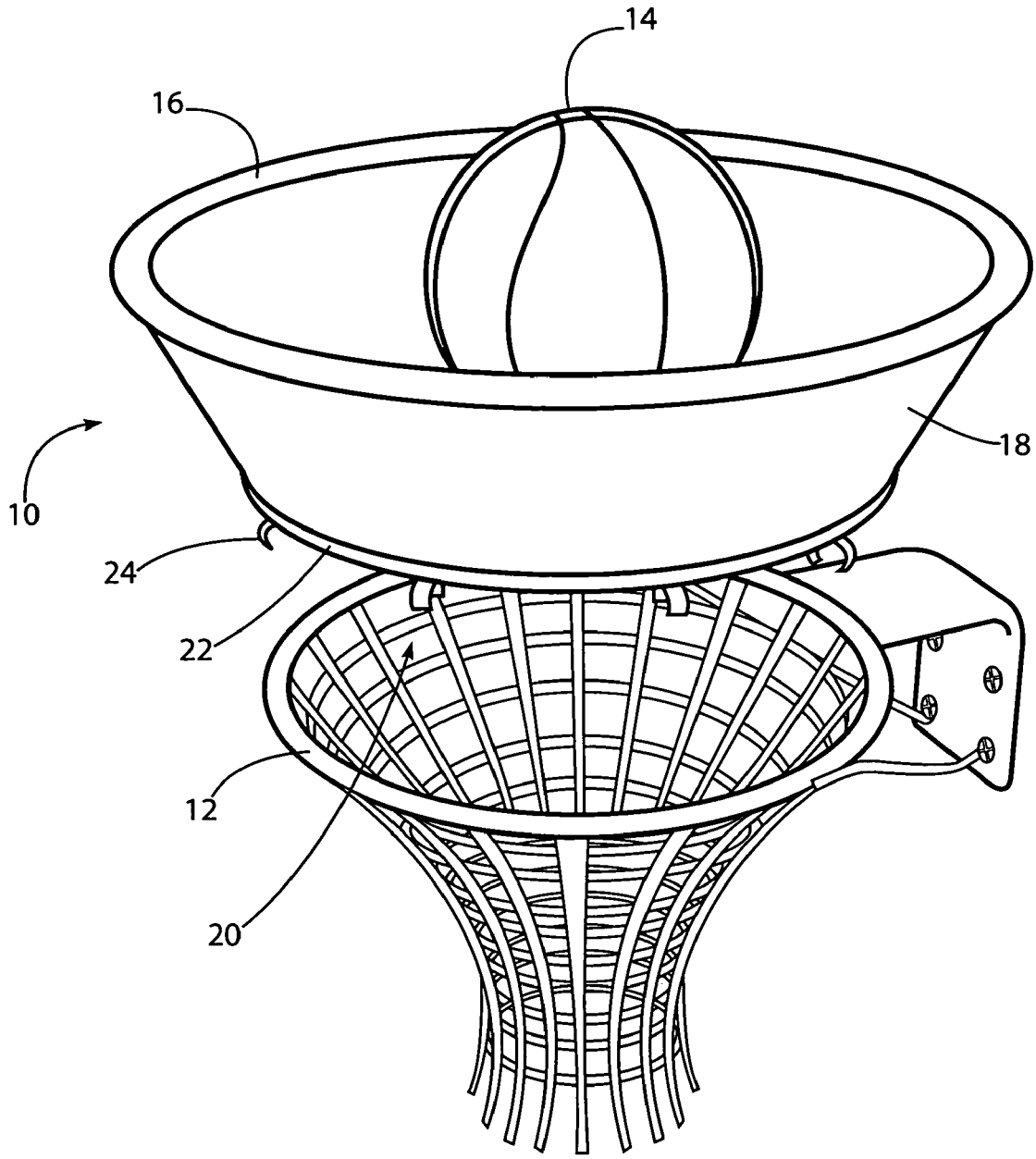
FIG. 1 is a perspective view of an oversized basketball rim device that retrofits onto a standard sized basketball rim according to one embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIG. 1 of the drawings. Illustrated therein is one presently preferred embodiment of an oversized basketball rim device, generally designated 10, for retrofitting onto an existing standard sized basketball rim 12 attached to a backboard (not shown) of a raised goal (not shown) which increases an opportunity of making a basket when shooting a basketball 14. The oversized basketball rim device 10 includes an upper rim member 16 having a diameter greater than a diameter of such standard sized basketball rim 12.

There is a funnel shaped band member 18 having an upper portion connected to the upper rim member 16 for directing basketball 14 from in such upper rim member 16 down through the standard sized basketball rim 12.

A lower rim member 22 having substantially same diameter as the diameter of such standard sized basketball rim 12 and connected to a lower portion of the funnel shaped band member 18 seats against such standard sized basketball rim 12.

There is also an attachment means 20 that is affixed to the lower rim member 22 for attaching such oversized basketball rim device 10 to the standard sized basketball rim 12. The attachment means 20, preferably, includes a predetermined plurality of clip members 24.

The diameter of such lower rim member 22 and the diameter of such standard sized basketball rim 12 are generally about 18 inches.

The diameter of the upper rim member 16 is, preferably, one of generally about 21 inches and 24 inches. Obviously, however, the diameter can be somewhat smaller or larger as long as it is wider than the standard sized basketball rim 12 to gain the benefits of the present invention.

The oversized basketball rim device 10 in this embodiment of the invention is, preferably, made of at least one of plastic and metal.

Figure 2:
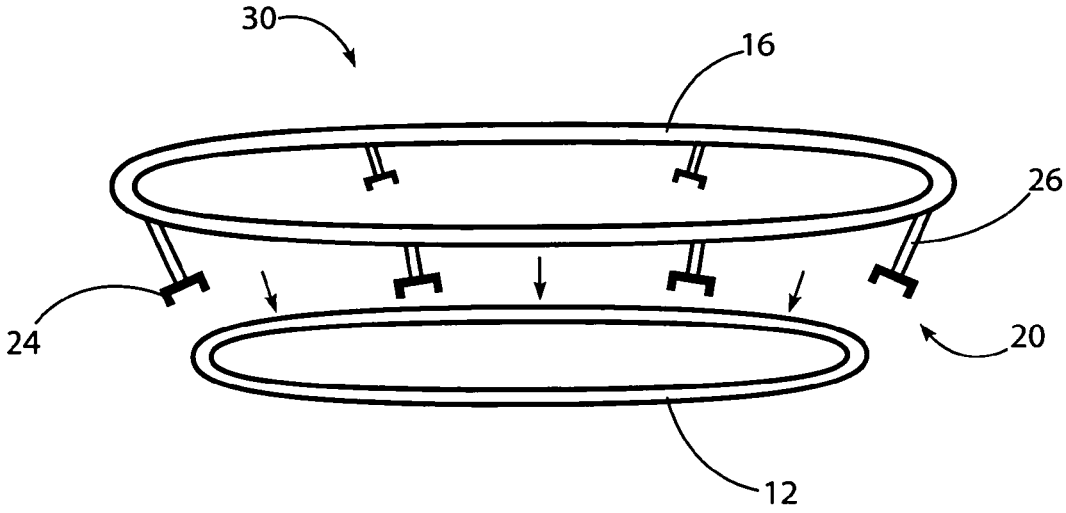
FIG. 2 is a perspective view of an oversized basketball rim device according to another embodiment of the present invention.

Reference is now made, more particularly, to FIG. 2 of the drawings. Illustrated therein is an alternative embodiment of an oversized basketball rim device, generally designated 30, for retrofitting onto existing standard sized basketball rim 12 attached to a backboard (not shown) of a raised goal (not shown) which increases an opportunity of making a basket when shooting basketball 14 (shown in FIG. 1).

The oversized basketball rim device 30 includes a predetermined plurality of spaced apart rod members 26 having an upper portion connected to the upper rim member 16 for directing basketball 14 from in such upper rim member 16 down through the standard sized basketball rim 12.

A clip member 24 of attachment means 20 is affixed to a lower portion of each of such predetermined plurality of rod members 26 for attaching the upper rim member 16 of oversized basketball rim device 30 to standard sized basketball rim 12.

The oversized basketball rim device 30 in this embodiment of the invention is, preferably, made of at least one of plastic and metal.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An oversized basketball rim device for retrofitting onto an existing standard sized basketball rim attached to a backboard of a raised goal which increases an opportunity of making a basket when shooting a basketball, said oversized basketball rim device comprising:

(a) a circular upper rim member having a diameter greater than a diameter of such standard sized basketball rim;

(b) a frusto conical shaped band member having an upper portion connected to said upper rim member for directing a basketball from in said upper rim member down through such standard sized basketball rim, said frusto-conical shaped band member having a solid wall portion disposed between said upper portion and a lower portion thereof;

(c) a circular lower rim member having substantially a same diameter as such diameter of such standard sized basketball rim and connected to said lower portion of said frusto conical shaped band member for seating against such standard sized basketball rim; and (d) an attachment means affixed to said lower rim member for attaching said oversized basketball rim device to such standard sized basketball rim.

2. An oversized basketball rim device, according to claim 1, wherein said diameter of said upper rim member is generally about 21 inches and such diameter of such standard sized basketball rim is generally about 18 inches.

3. An oversized basketball rim device, according to claim 1, wherein said diameter of said upper rim member is generally about 24 inches and such diameter of such standard sized basketball rim is generally about 18 inches.

4. An oversized basketball rim device, according to claim 1, wherein said diameter of said lower rim member and such diameter of such standard sized basketball rim are generally about 18 inches.

5. An oversized basketball rim device, according to claim 1, wherein said attachment means includes a predetermined plurality of clip members.

6. An oversized basketball rim device, according to claim 1, wherein said oversized basketball rim device is made of at least one of plastic and metal.

7. In combination with a standard basketball arrangement including a rim, a backboard and a means for positioning said rim a predetermined distance above ground level, the improvement comprising:

(a) a circular upper rim member for directing a basketball from in said upper rim member down through said standard rim;

(b) a frusto conical shaped band member having an upper portion connected to said upper rim member for directing a basketball from in said upper rim member down through such standard sized basketball rim, said frusto-conical shaped band member having a solid wall portion disposed between said upper portion and a lower portion thereof;

(c) a circular lower rim member having substantially a same diameter as such diameter of such standard sized basketball rim and connected to said lower portion of said frusto conical shaped band member for seating against such standard sized basketball rim; and (d) an attachment means affixed to said lower rim member for attaching said upper rim member, said tunnel shaped band member and said lower rim member to said standard rim.

* * * * *